US007784305B2

(12) United States Patent
Slinkard

(10) Patent No.: US 7,784,305 B2
(45) Date of Patent: Aug. 31, 2010

(54) SLIDE FOR OMEGA NECKLACE

(76) Inventor: Joan T. Slinkard, 922 Downey Dr., Nashville, TN (US) 37205

( * ) Notice: Subject to any disclaimer, the term of this patent is extended or adjusted under 35 U.S.C. 154(b) by 83 days.

(21) Appl. No.: 12/216,696

(22) Filed: Jul. 9, 2008

(65) Prior Publication Data

US 2009/0084135 A1 Apr. 2, 2009

Related U.S. Application Data

(60) Provisional application No. 60/960,434, filed on Sep. 28, 2007.

(51) Int. Cl.

| | |
|---|---|
| ***A44C 7/00*** | (2006.01) |
| ***A44C 11/00*** | (2006.01) |
| ***A44C 25/00*** | (2006.01) |
| ***A44C 13/00*** | (2006.01) |
| ***A44C 5/00*** | (2006.01) |

(52) U.S. Cl. ..... 63/13; 63/21; 63/23; 63/40; 63/3; 63/1.17

(58) Field of Classification Search ..... 63/3, 63/3.1, 3.2, 4, 21, 22, 23, 40, 1.17, 1.18, 63/38, 13

See application file for complete search history.

(56) References Cited

U.S. PATENT DOCUMENTS

| | | | | |
|---|---|---|---|---|
| 296,542 | A | 4/1884 | Draper | |
| 301,491 | A | 7/1884 | Gibbons | |
| 393,239 | A * | 11/1888 | Johnstone | 63/1.12 |
| 1,028,217 | A | 6/1912 | Jacques | |
| 2,957,216 | A * | 10/1960 | Mule | 24/3.1 |
| 3,094,754 | A | 6/1963 | Wayne | |
| 4,265,098 | A * | 5/1981 | Wayne | 63/1.16 |
| 5,022,237 | A * | 6/1991 | Monderer et al. | 63/23 |
| 5,031,420 | A * | 7/1991 | Song | 63/21 |
| 5,052,195 | A * | 10/1991 | Lunt | 63/21 |
| 5,097,679 | A | 3/1992 | Johnson et al. | |
| 6,293,128 | B1 * | 9/2001 | Leufray-Simms | 63/23 |
| 6,381,985 | B1 * | 5/2002 | Burgard | 63/29.1 |
| D469,717 | S | 2/2003 | Chia et al. | |
| 6,729,159 | B2 * | 5/2004 | Rose | 63/29.1 |
| 6,769,270 | B2 * | 8/2004 | Takessian | 63/29.1 |
| 7,120,974 | B2 | 10/2006 | Suganuma | |
| 2003/0131449 | A1 * | 7/2003 | McCormack | 24/3.4 |

(Continued)

FOREIGN PATENT DOCUMENTS

| | | |
|---|---|---|
| JP | 6078815 | 3/1994 |

*Primary Examiner*—Victor Batson
*Assistant Examiner*—David Reese
(74) *Attorney, Agent, or Firm*—Richard C. Litman

(57) ABSTRACT

The slide for an Omega necklace has an ornamental front face and a catch attached to a rear face thereof. The slide has loops that an Omega necklace chain can slide through. The catch is preferably in the form of a figure 8 (or modified figure 8) safety clasp that is elongated and curved. The clasp may be fixed either vertically or horizontally on a hinge and snaps closed, having a first loop at one end that pivots in a tube and a second loop or buttonhole at the opposite end that engages a ball-shaped catch. The hinge may be oriented to accommodate either the vertical or horizontal arrangement. The curved clasp can accommodate the bails of various sizes and types of pendants, and allows the slide to be worn alone or with a pendant suspended from the slide.

6 Claims, 7 Drawing Sheets

U.S. PATENT DOCUMENTS

2005/0103050 A1 5/2005 Rancan
2005/0247079 A1 11/2005 Padeh
2006/0112727 A1 6/2006 Castaneda, Jr.
2006/0185393 A1 8/2006 Cherry et al.

* cited by examiner

SLIDE FOR OMEGA NECKLACE

CROSS-REFERENCE TO RELATED APPLICATION

This application claims the benefit of U.S. Provisional Patent Application Ser. No. 60/960,434, filed Sep. 28, 2007.

BACKGROUND OF THE INVENTION

1. Field of the Invention

The present invention relates to jewelry, and more particularly to a slide for an Omega necklace that has a clasp permitting interchangeable pendants to be attached to the slide.

2. Description of the Related Art

The Omega necklace is a well-known type of necklace. While there are variations in terminology, the term "Omega necklace" generally refers to a necklace made with an Omega chain, which is a chain formed from smooth rectangular plates set side-by-side with their ends crimped around a strip of metal mesh. Some Omega necklaces may be domed, so that instead of being flat from edge to edge, at least some of the plates are raised to a slightly higher elevation in the middle of the width of the necklace, creating a different visual appearance as the light reflects from the plates.

Because the Omega chain is made from plates rather than linked rings, and because of the width of the chain, it is difficult to attach conventional pendants to an Omega necklace. More commonly, a slide is used with an Omega necklace. A typical slide may be a flat plate having a pair of loops on its back face and an ornamental front face, with the necklace being placed through the pair of loops so that the slide is slidable on the Omega chain. Other slides may have an ornamental body that is formed with one or two loops large enough to extend the Omega chain therethrough. However, such designs typically incorporate the pendant into the slide so that the pendant cannot be freely suspended from the Omega necklace chain, but is, rather, built into the slide. Moreover, it is not possible to use the same slide with interchangeable pendants. Thus, a slide for an Omega necklace solving the aforementioned problems is desired.

SUMMARY OF THE INVENTION

The slide for an Omega necklace has an ornamental front face and a catch attached to the rear face thereof. The slide has loops that an Omega necklace chain can slide through. The catch is preferably in the form of a figure 8 (or modified figure 8) safety clasp that is elongated and curved. The clasp may be fixed either vertically or horizontally on a hinge and snaps closed, having a first loop at one end that pivots in a tube and a second loop or buttonhole at the opposite end that engages a ball-shaped catch. It should be noted that the hinge may be oriented with the pintle aligned either the vertically or horizontally, depending upon the particular style of the slide. The curved clasp can accommodate the bail of various sizes and types of pendants, and allows the slide to be worn alone or with a pendant suspended from the slide.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention relates to a slide for an Omega necklace that permits attaching interchangeable pendants thereto so that the pendants are suspended from the slide. The slide is capable of embodiment in several ornamental forms, all of which have loops through which an Omega chain can extend and slide through, and a clasp on the rear face of the slide to which a pendant bail can be attached.

Figure 1:
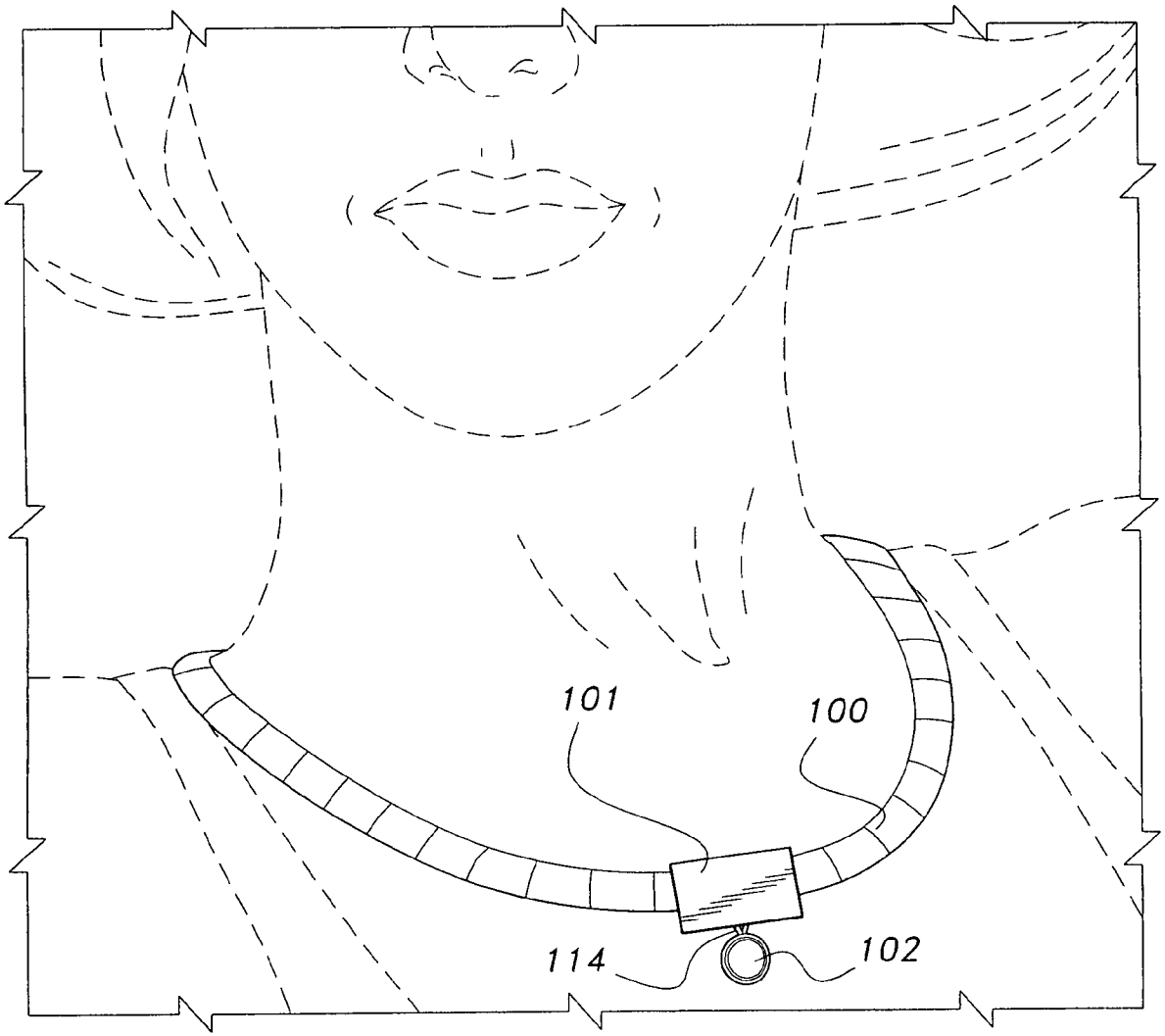
FIG. 1 is an environmental, perspective view of a first embodiment of a slide for an Omega necklace according to the present invention.
Figure 2:
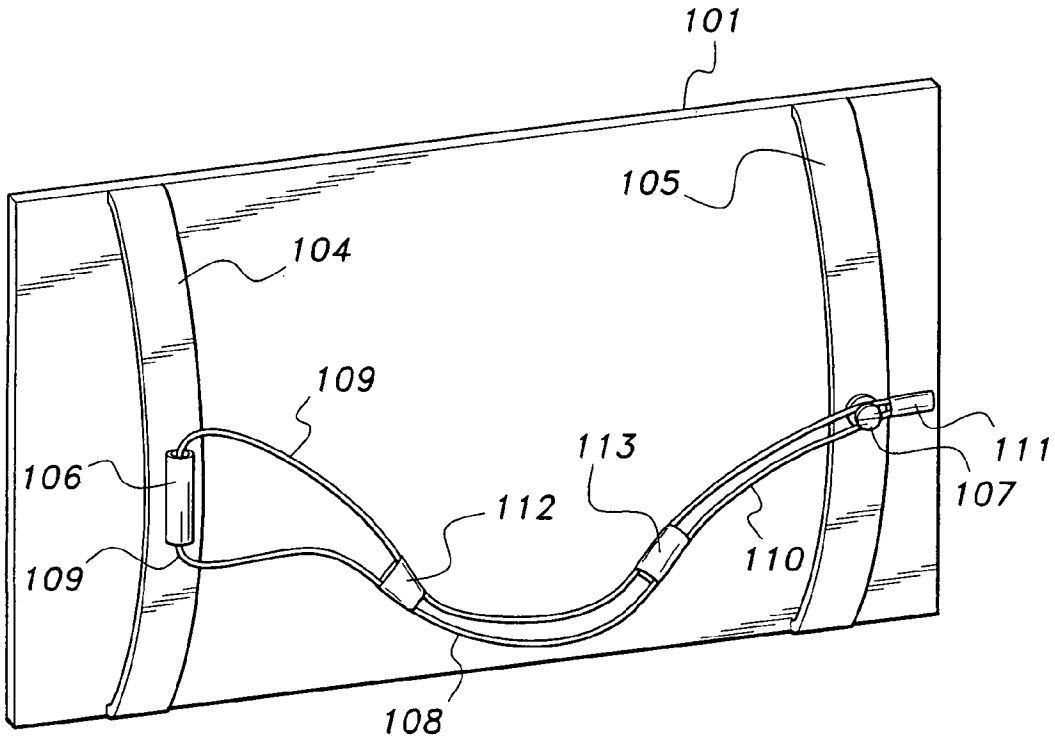
FIG. 2 is a rear view of the slide of FIG. 1, showing a clasp attached thereto.
Figure 3:
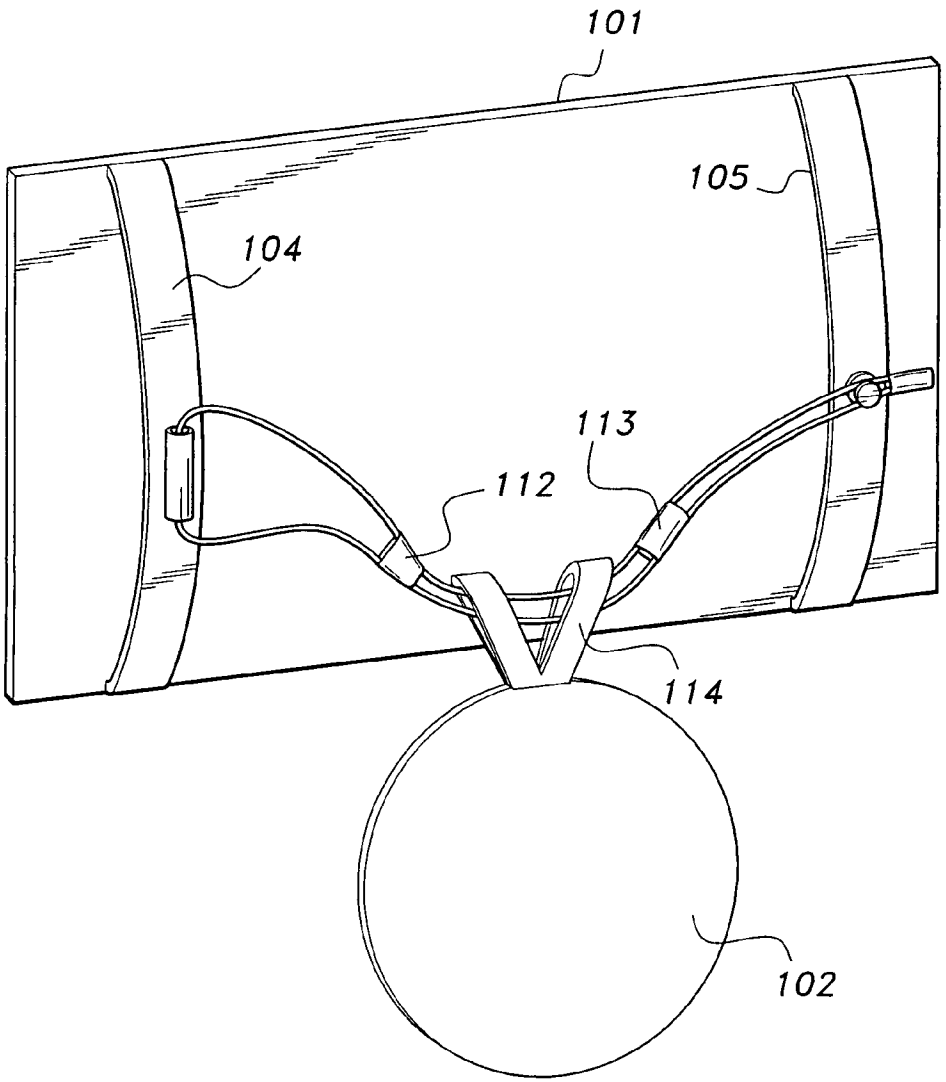
FIG. 3 is an environmental rear view of the slide of FIGS. 1 and 2, showing a pendant attached to the clasp.

FIGS. 1-3 show a first embodiment of a slide for an Omega necklace, designated generally as 101 in the drawings. The rear of slide 101 has solid parallel bars adjacent the ends of the slide 101, forming loops 104 and 105 for freely sliding on an Omega necklace chain 100. Loop 104 is provided with a solid tube 106 of gold that extends vertically, and loop 105 is provided with a button 107.

Referring to FIG. 2, an elongated, curved "figure 8" clasp 108, or modified figure 8, is provided at one end of a wire forming a first loop 109 that has a substantially linear portion that extends through the tube 106 in order to pivot about the tube 106 to form a hinge for the clasp 108. The opposite second end of clasp 108 is provided with a solid extension forming a finger tab 111 for opening the clasp 108. A second loop or buttonhole 110 is formed by the clasp 108 adjacent the finger tab 111 for cooperating with the button 107 to close the clasp 108. The second loop or buttonhole 110 is of sufficient size to fit over button 107. Solid gold areas 112 and 113 are provided to impart stability to the open work of the clasp 108. The body of the elongated clasp 108 is curved or arched away from the rear face of the slide 101 in the center portion to allow clearance for a pendant bail.

In use, the figure 8 clasp 108 secures the bail 114 of a pendant 102 to the slide 101 between the loops 104 and 105, as shown in FIGS. 1 and 3, so that the ornamental pendant 102 is suspended from the slide 101, but with only a short length of bail 114 extending below the slide 101 so that the pendant 102 appears to be incorporated with the slide 101. Pulling on the finger tab 111 pivots the clasp 108 horizontally about a vertically disposed axis to open the clasp 108 to allow removal of the pendant 102 and the attachment of other interchangeable pendants of different ornamental design. Since the curve of the clasp 108 does not extend below the bottom edge of the slide 101, the slide 101 can be worn with or without a pendant. Although the clasp 108 is shown pivoting about a vertical axis in the drawings, it should be understood that the vertically pivoting clasp is shown for exemplary purposes only, and that the clasp may, alternatively, pivot about a horizontal axis, depending upon the particular design of the slide.

Figure 4:
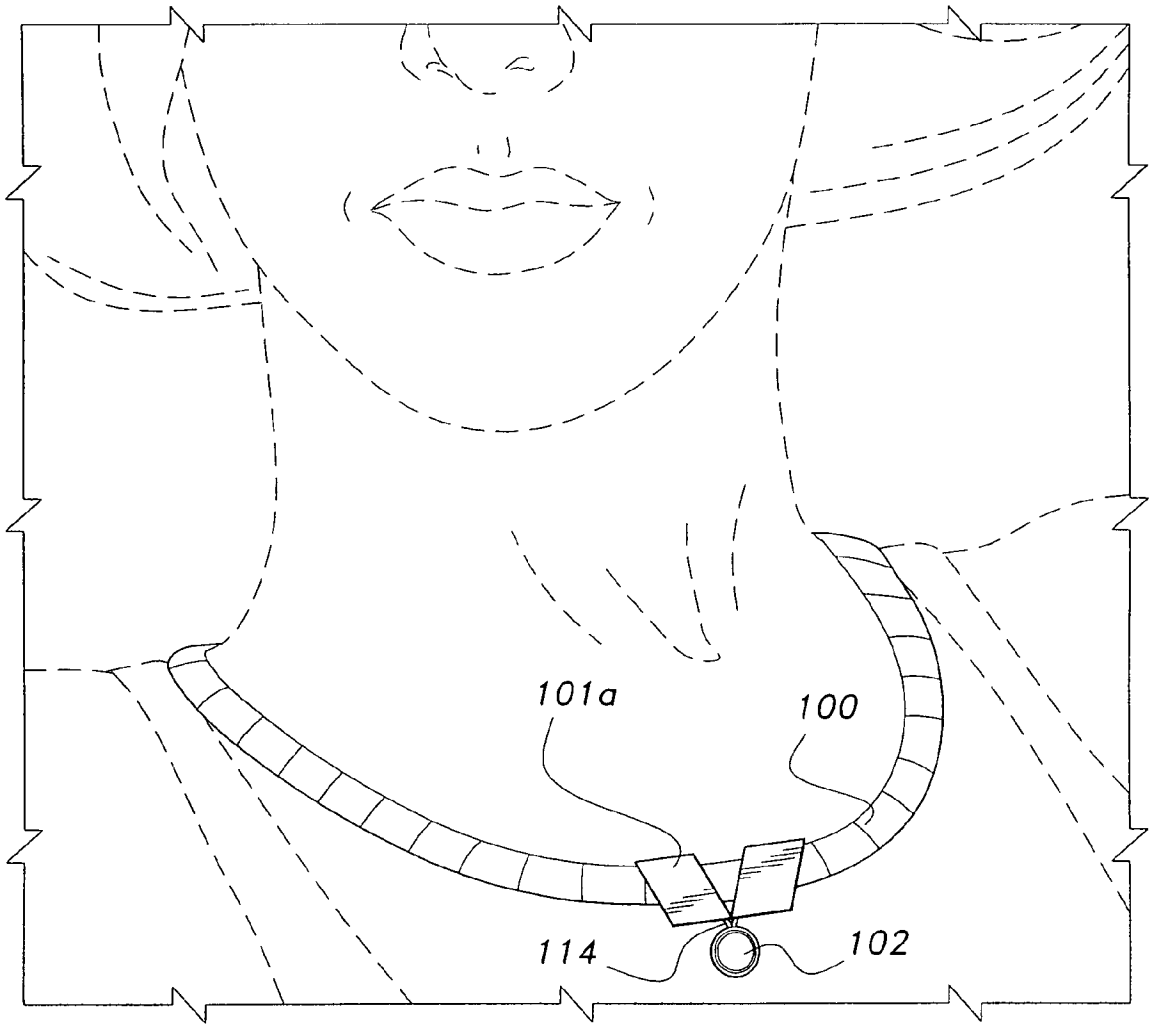
FIG. 4 is an environmental, perspective view of an alternative embodiment of a slide for an Omega necklace according to the present invention.
Figure 5:
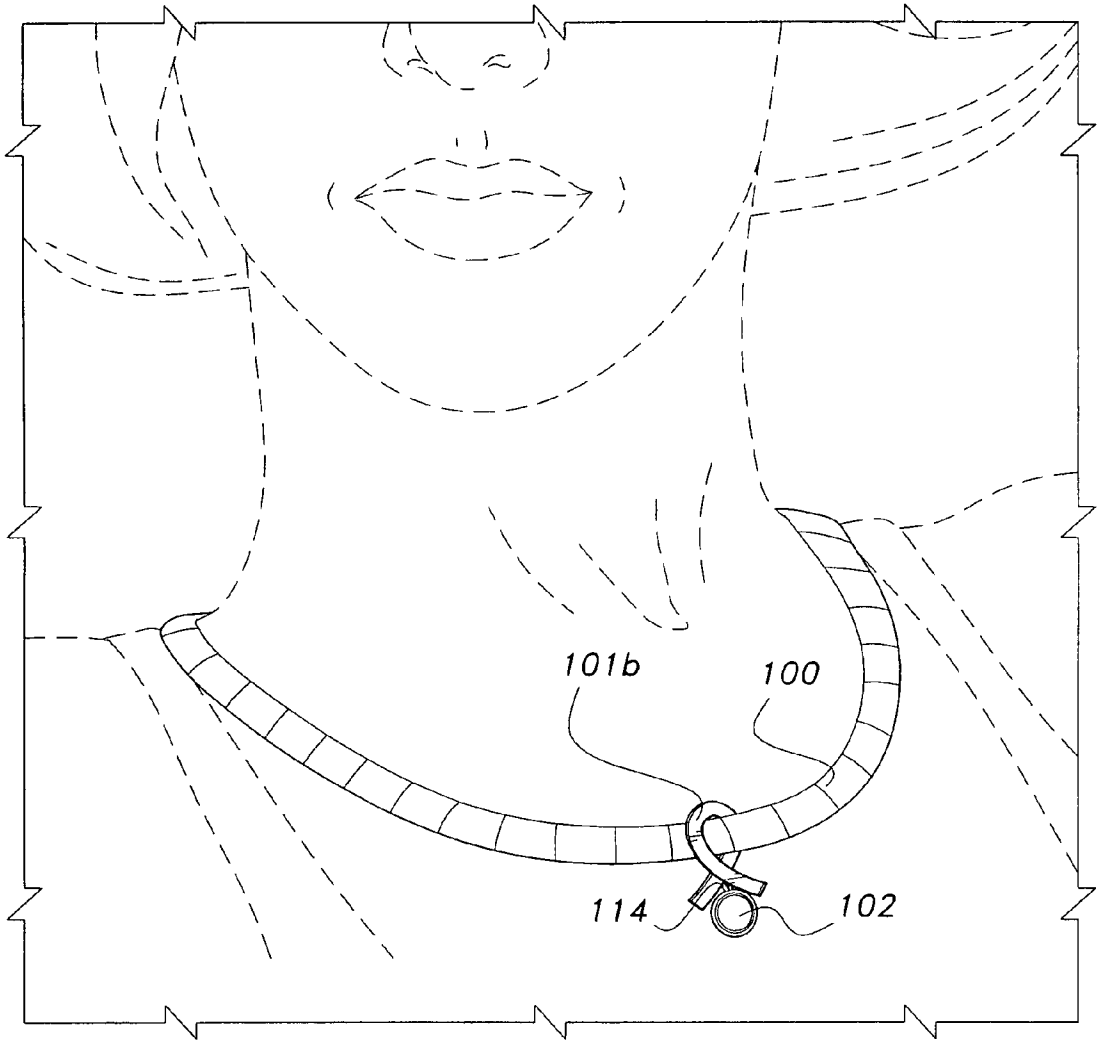
FIG. 5 is an environmental, perspective view of another alternative embodiment a slide for an Omega necklace according to the present invention.
Figure 6:
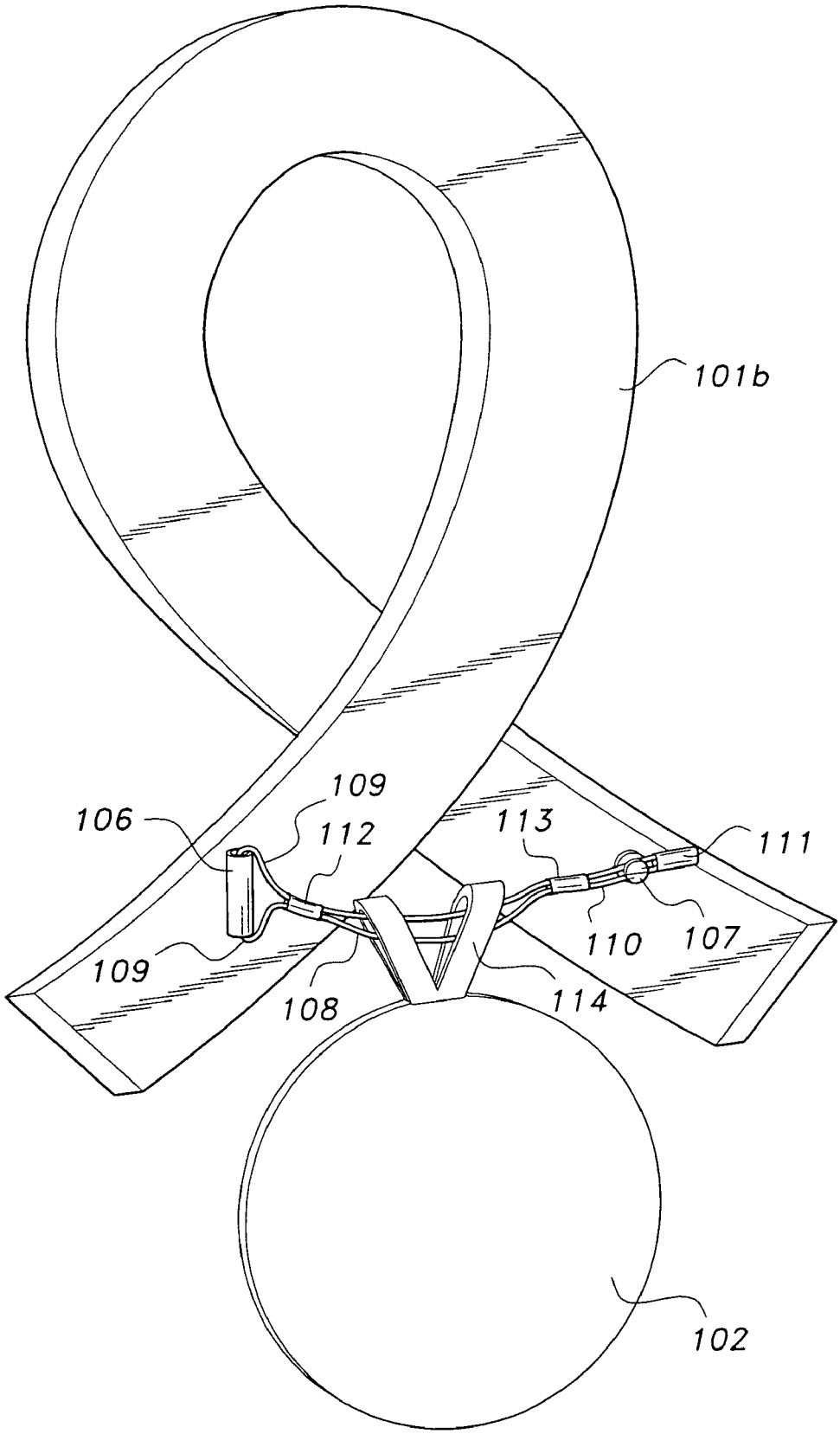
FIG. 6 is a rear perspective view of the slide of FIG. 5, showing a pendant attached to the clasp.

The clasp 108, as described above, is readily adaptable for use with various slide designs. Referring to FIGS. 4-6, various slide designs are depicted with a pendant 102. The slide 101*a*, shown in FIG. 4, has a generally V-shaped body, while the slide 101*b*, shown in FIGS. 5 and 6, is of a type known as a "love knot," with the Omega necklace chain 100 extending directly through the knot or loop formed by the decorative body of the slide 101*b*. Similar to FIGS. 1-3, the elongated safety clasp 108 opens freely to slide through a bail 114. A small portion of the bail 114 extends below the slide 101, as seen in FIGS. 1, 4, and 5. As shown in FIG. 6, the clasp tube 106 and the button 107 are attached directly to the rear face of the body of the slide 102*b*, rather than indirectly to slider loops attached to the rear face through which chain 100 would extend.

Figure 7:
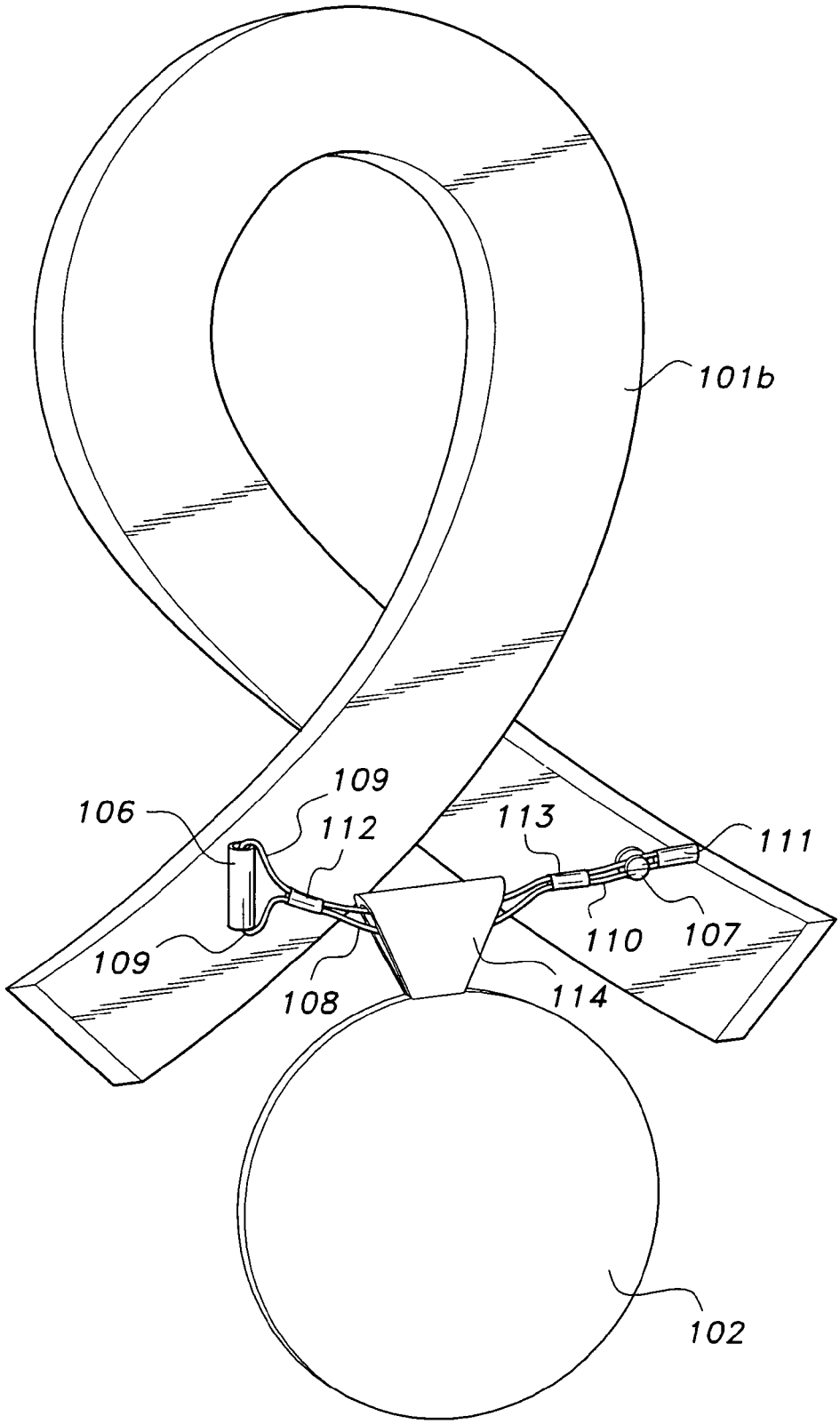
FIG. 7 is a rear perspective view of an alternative embodiment of the slide of FIG. 5, showing a pendant attached to the clasp.

In FIG. 7, bail 114 of FIG. 6 is formed as a solid piece, as opposed to the "rabbit ears" configuration seen in FIG. 6. The solid bail 114 of FIG. 7 is used when it is desired to hide the clasp and not show the clasp through the opening of the decorative body 101*b*. It should be understood that the slides, chains and pendants illustrated in FIGS. 1-6 are shown for exemplary purposes only, other variations in ornamental design being within the scope of the present invention. It is to be understood that the present invention is not limited to the embodiment described above, but encompasses any and all embodiments within the scope of the following claims.

I claim:

1. A slide for an Omega necklace, comprising:

a slide body having a decorative front face and a rear face, the slide body having at least one loop adapted for extending an Omega necklace chain therethrough, wherein said slide body has opposed first and second ends;

a clasp attached to the rear face of the slide body, the clasp being adapted for attaching a pendant bail thereto, wherein said clasp is formed from parallel wires having opposed first and second looped ends;

the slide further comprising a hollow tube mounted to the rear face of said slide body adjacent the first end thereof, the first looped end of said clasp extending through the hollow tube to form a hinge so that said clasp is pivotal about an axis defined by the tube;

a button catch disposed on the rear face of said slide body adjacent the second end thereof, said clasp releasably engaging the button catch to releasably secure the second looped end of said clasp to said slide body; and a pair of opposed bars formed on the rear face of said slide body, each of the bars having a central portion spaced apart from the rear face so that the Omega necklace chain may pass between the bars and the rear face, the hollow tube being disposed on one of the bars and the button being disposed on the opposed bar.

2. The slide for an Omega necklace as recited in claim 1, further comprising at least one solid mass disposed on a central portion of said clasp to impart stability to said clasp.

3. The slide for an Omega necklace as recited in claim 1, further comprising a finger tab extending from the second looped end of said clasp.

4. A slide for an Omega necklace, comprising:

a slide body having a decorative front face and a rear face;

a first slide loop and a parallel second slide loop mounted on the rear face of the slide body adjacent to first and second ends of the slide body, the slide loops being adapted for passage of an Omega necklace chain therethrough so that the slide is slidable upon the chain;

a tube attached vertically to the first slide loop;

a button catch attached to the second slide loop; and an elongated safety clasp defining a first clasp loop at one end of the clasp, the first clasp loop extending through the tube to form a hinge, the clasp further defining a second clasp loop at the opposing end of the safety clasp, the second clasp loop forming a releasable snap engagement with the button catch to secure the clasp, the safety clasp being adapted for supporting a pendant bail between opposing ends thereof.

5. The slide for an Omega necklace as recited in claim 4, further comprising at least one solid mass disposed on a central portion of said elongated safety clasp for imparting stability to the clasp.

6. The slide for an Omega necklace as recited in claim 4, further comprising a finger tab extending from the second clasp loop of said elongated safety clasp.

* * * * *